United States Patent [19]

Bechle et al.

[11] 4,294,906

[45] Oct. 13, 1981

[54] INSTANT PROCESSING SLEEVE

[75] Inventors: Philip D. Bechle, Rochester; Joseph A. Roth, Webster, both of N.Y.

[73] Assignee: Eastman Kodak Company, Rochester, N.Y.

[21] Appl. No.: 140,072

[22] Filed: Apr. 14, 1980

[51] Int. Cl.[3] ..... G03C 1/48

[52] U.S. Cl. ..... 430/207; 430/210; 430/259; 430/256; 430/497; 430/499

[58] Field of Search ..... 430/207, 210, 497, 499, 430/259, 256

[56] References Cited

U.S. PATENT DOCUMENTS

| | | | |
|---|---|---|---|
| 3,325,642 | 6/1967 | Emerson | 430/207 |
| 3,357,331 | 12/1967 | Erikson | 430/207 |
| 3,586,501 | 6/1971 | Norquist et al. | 430/207 |
| 3,802,887 | 4/1974 | Sorli | 430/207 |
| 3,977,877 | 8/1976 | Oishi | 430/207 |
| 4,042,395 | 8/1977 | Tone et al. | 430/499 |

*Primary Examiner*—Charles L. Bowers, Jr.
*Attorney, Agent, or Firm*—J. B. Turner

[57] ABSTRACT

A photographic processing sleeve is provided for receiving and processing a dye donating instant film sheet to produce a photographic print. The sleeve comprises a film retaining sheet that is folded over along its lateral edges to form channels which slidably receive the film sheet, and edge strips, sometimes called side rails, which space the film sheet from the image-receiving sheet. After processing, at least a major portion of the image-receiving sheet, including the finished picture, is adapted to be peeled apart from the rest of the sleeve which can then be discarded.

6 Claims, 6 Drawing Figures

INSTANT PROCESSING SLEEVE

The present invention relates to self-processing photographic film units, also called instant film units. More specifically, the invention relates to a simple and versatile processing sleeve for receiving and processing in the sleeve a photograhically exposed film sheet.

Typically, instant film is processed by covering the film sheet with a second sheet and distributing a viscous processing fluid therebetween. The fluid permeates the photosensitive layers of the film sheet and initiates development of the latent image. Development, in turn, controls diffusion of an imagewise distribution of materials, such as dyes, which transfer to an image-receiving layer where they form the visible picture.

Instant film units having the above general characteristics are well known in many different formats. Those most relevant to the present invention are referred to as "peel-apart" film units, because the image-receiving layer is in the second sheet, called the image-receiving sheet, and that sheet is peeled apart from the remainder of the film unit after processing.

In accordance with one type of peelapart film unit, adapted to be handled as an individual film unit, rather than in a pack, a processing sleeve is provided to protect the film sheet prior to the intended exposure and to hold the film sheet and image-receiving sheet in superposition during processing. The film sheet is removed from the sleeve for exposure and returned for processing. After processing, the sleeve is torn open and the image-receiving sheet is peeled away from the film sheet in the usual manner for peel-apart film units.

U.S. Pat. No. 3,586,501, issued in the name of W. E. Norquist on June 22, 1971, depicts an example of a film unit of this type, including an opaque sleeve which carries the image-receiving sheet, a pouch for supplying the processing fluid, side rails for spacing the film and image-receiving sheets apart to control the depth of the distributed processing fluid and a mask for framing the final picture. The opaque sleeve acts as a miniature dark room that contains the film sheet and protects it from fogging. In use: (1) the entire film unit, i.e., the sleeve with the film sheet inside, is loaded into a camera; (2) the film sheet is held by the camera while the sleeve is withdrawn through a light-locked exit slot to uncover the film sheet for exposure; (3) the film sheet is exposed; (4) the sleeve is returned to its position in the camera covering the film sheet; and (5) the entire film unit is transported from the camera through a pair of opposed pressure rollers. The roller pressure ruptures the pouch, distributes the processing fluid, and initiates processing of the film sheet. After a suitable period for development and dye transfer, the sleeve is torn open, the image-receiving sheet is peeled away to provide the finished picture, and the remainder of the film unit is discarded.

Although previously known processing sleeves have been satisfactory for their intended purpose, they include a relatively large number of parts and are undesirably complex to manufacture, difficult to use and limited in versatility. It will become apparent from the following specification, on the other hand, that the present invention overcomes these disadvantages to a major extent, and provides a processing sleeve that offers further important advantages.

SUMMARY OF THE INVENTION

In accordance with the present invention, a processing sleeve is provided for receiving and processing a diffusion transfer instant film sheet. The sleeve is conveient to use and is constructed from a relatively small number of elements to simplify its manufacture.

In a preferred embodiment of the invention, the sleeve comprises a film retaining sheet that is doubled or folded over along its lateral edges to form channels which slidably receive the film sheet, and edge strips, sometimes called side rails, which space the film sheet from the imagereceiving sheet. A pouch of processing fluid is coupled to one end of the sleeve for dispensing a processing fluid distributable between the film and image-receiving sheets such that the side rails of the retaining sheet control the initial depth of the distributed fluid layer. After processing, at least a major portion of the image-receiving sheet, including the finished picture, is adapted to be peeled apart from the rest of the sleeve which can then be discarded.

In accordance with other features of the invention, the portion of the image-receiving sheet that includes the finished picture comprises an outermost portion of one face of the sleeve which is directly accessible for removal from the remainder of the sleeve.

Still other aspects of the invention, and more specific features, will become apparent to those skilled in the art from the following detailed description of the preferred embodiment considered together with the accompanying drawings.

BRIEF DESCRIPTION OF THE DRAWINGS

Reference is made to the accompanying drawings, in which.

DETAILED DESCRIPTION OF PREFERRED EMBODIMENT

Referring now to the accompanying drawings, a processing sleeve 11, in accordance with a preferred embodiment of the present invention, is depicted for use with an instant film sheet 13. The sleeve and the film sheet together cooperate to form a film unit.

The film sheet is not illustrated in detail, but should be understood to include one or more photosensitive silver halide emulsion layers that record a latent image when exposed to a scene. The exposed sheet is processable by a viscous fluid that initiates development of the latent image and brings about the diffusion of an imagewise distribution of transferable materials suitable for forming a visible image. In this case of transferable materials are dyes that are complementary to the light sensitivities of the emulsion layers, and that diffuse to a surface of the photosensitive sheet where they are transferable to an image-receiving sheet. A more detailed description of a suitable film sheet and process is contained in copending U.S. patent application Ser. No. 837,778, entitled Process of Formation of Color Images, Photographic Product and Treatment Solutions Useful for Putting the Process Into Practice, filed on September 29, 1977 now U.S. Pat. No. 4,186,004, issued Jan. 29, 1980 in the name of Jean Dealriges et al.

Figure 4:
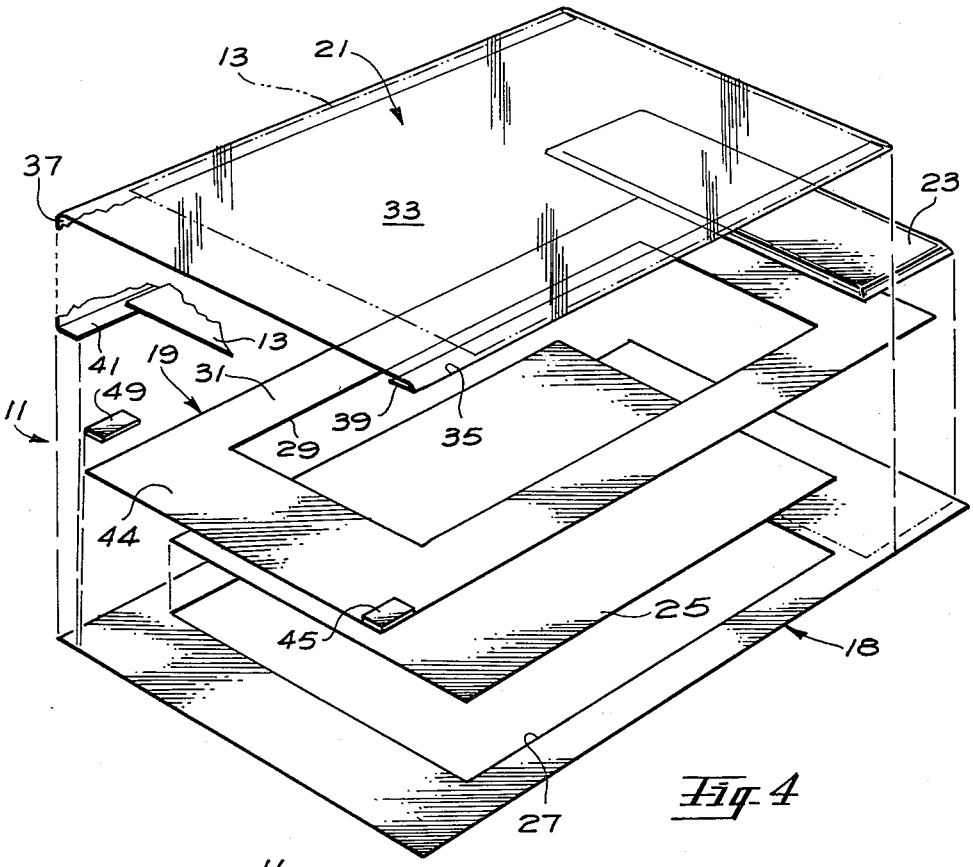
FIG. 4 is an exploded view of the processing sleeve of FIG. 2.
Figure 5:
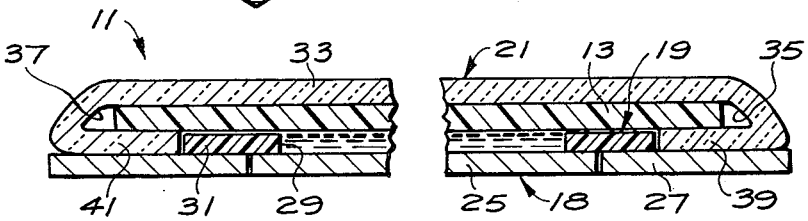
FIG. 5 is a cross-sectional end view taken along lines 5—5 in FIG. 3.

A film sheet of the type mentioned above is particularly convenient for use with the processing sleeve of the present invention. As depicted in FIGS. 4 and 5, the sleeve includes an image-receiving sheet 18, a mask 19, a film retaining sheet 21 and a fluid pouch 23.

The image-receiving sheet includes an image-receiving layer for accepting the diffusible dyes transferred from the film sheet, and for immobilizing the dyes to construct a visible photographic print. As will become more apparent hereinafter, a central image-receiving portion 25 of the receiving sheet is scored to sever it from the surrounding edge portion 27 so the central portion can easily be removed from the remainder of the sleeve.

The mask is a sheet of fluid impervious material having a central aperture 29 that defines the imaging area during processing. The dyes from the film sheet move through the aperture to the central image-receiving portion of the receiving sheet, but are blocked by mask border 31 to provide uniform borders around the transferred image. The mask also covers the score line between the central and surrounding portions of the image-receiving sheet, both to prevent the processing fluid from escaping therethrough and, with a suitable adhesive, to hold the central and edge portions of the receiving sheet together in a common plane.

The film retaining sheet 21 comprises a flat central section having film sheet retaining structure along each of its lateral edges. In the disclosed embodiment the film sheet retaining structure is formed by folding and doubling over the edge strip portions 39 and 41 of the sheet 21 to form channels 35 and 37 within the folds for receiving the film sheet. When the film unit is assembled the edge strips 39 and 41 form side rails that are disposed between the imagereceiving sheet and the film sheet to space the film sheet from the image-receiving sheet by the thickness of the edge strips. The central section 33 thus cooperates with the image-receiving sheet to form a pocket for the film sheet, while the channels defined by the folds slidably receive the film sheet, guide it into superposition with the image-receiving sheet (see FIG. 2) and space it from the image-receiving sheet by a predetermined amount for purposes to be described hereinafter. As depicted in FIG. 5, the mask 31 is thinner than the edge strips, so the strips, and not the mask, control the spacing between the film and imagereceiving sheets.

Figure 1:
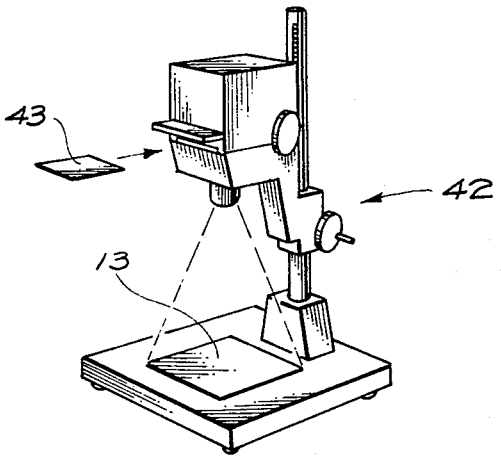
FIG. 1 is a schematic perspective view of a photographic enlarger for exposing instant film sheets usable with processing sleeves in accordance with the present invention.
Figure 2:
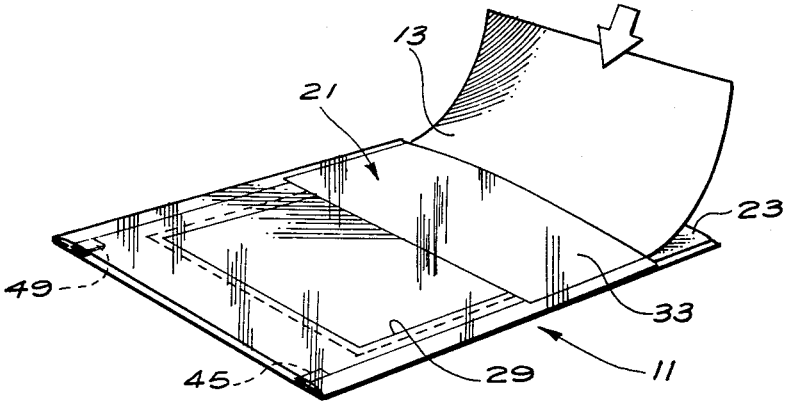
FIG. 2 is a perspective view of a processing sleeve in accordance with a preferred embodiment of the present invention, with an instant film sheet partially inserted into the sleeve.
Figure 3:
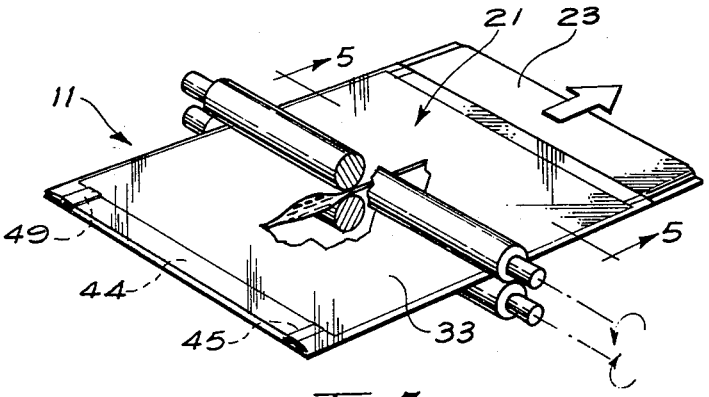
FIG. 3 is a perspective view of the processing sleeve of FIG. 2, and the film sheet, as they are moved between a pair of pressure rollers to initiate processing of the film sheet.

Referring now to the operation of the processing sleeve, in conjunction with FIGS. 1–3, the film sheet is exposed in an enlarger 42, for example, by projecting light through a transparency master 43 onto the surface of the sheet. Of course the exposure would take place under dark conditions to prevent fogging of the film.

The processing sleeve is adapted to receive the film sheet after the exposure by sliding the sheet endwise into the sleeve (FIG. 2) until it is fully enclosed thereby. The sleeve, with the film sheet inside, is then advanced between a pair of pressure rollers (FIG. 3) to initiate processing.

As the sleeve moves between the pressure rollers (FIG. 3) they rupture the pouch and drive its contents toward the trailing end of the film unit, where any excess is collected in a fluid trap 44 between spacers 45 and 49. The same spacers can also serve as abutments to engage and locate the trailing end of the film sheet when it is first inserted into the sleeve.

The depth of the distributed fluid layer is controlled by the thickness of the edge strips 39 and 41. Soon after distribution, however, the fluid is absorbed by the various layers of the film and image-receiving sheets. Processing of the film sheet takes place, and, the dye imaging materials transfer to and are immobilized in, the image-receiving sheet.

Figure 6:
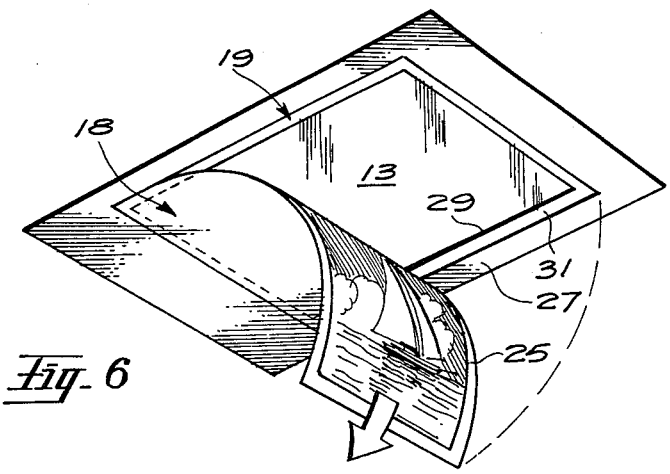
FIG. 6 is a perspective view depicting the removal after processing of the final picture from the remainder of the processing sleeve.

When dye transfer is completed, the final picture is recovered by peeling the central portion 25 (see FIG. 6) of the image-receiving sheet away from the remainder of the sleeve. It should be noted that this peelable central portion is directly accessible from the outside of the processing sleeve, so there is no need to open the sleeve first to reach the picture. In fact, the entire sleeve is formed by the already mentioned parts, which are significantly reduced in number from processing sleeves previously known in the prior art.

The outer sheet has been depicted as transparent. It should be apparent, however, that it could just as easily be opaque to provide a light tight sleeve that would permit daylight processing. Of course the film sheet would still have to be loaded in the dark.

It should be apparent from the proceeding description that the present invention provides a processing sleeve having important advantages not available from the teaching of the prior art. The structure is relatively simple to manufacture and includes only a small number of separate parts. It is versatile in application and convenient to use.

Although the invention has been described with particular reference to a preferred embodiment thereof it will be readily understood that variations and modifications can be effected within the spirit and scope of the invention as described hereinabove and as defined in the appended claims.

We claim:

1. A processing sleeve for receiving photographic film processable by a fluid to form an imagewise distribution of material for transfer by diffusion from the film to an image-receiving sheet; said sleeve comprising:

an image-receiving sheet including means for accepting and immobilizing the diffusion material from the film to form a visible image in the receiving sheet;

sheet means, superposed with said receiving sheet, including a generally flat section and doubled over portions, said portions and said flat section forming channels for slidably receiving the film into juxtaposition with said receiving sheet with the film between the portions and the flat section whereby the film is spaced from the receiving sheet; and means for supplying the processing fluid between the received film and said receiving sheet to process the film and bring about the transfer of the diffusion material to said receiving sheet with the doubled over portions assisting in establishing a predetermined depth of the processing fluid between the received film and said receiving sheet.

2. A processing sleeve for use with photograhic film processable by a fluid to form an imagewise distribution of material transferable by diffusion from the film to an image-receiving sheet; said sleeve comprising:

an image-receiving sheet including an image-receiving section for accepting and immobilizing the diffusion material from the film to form a dye image in the image-receiving section; said image-receiving section of said receiving sheet forming an outermost portion of said sleeve;

sheet means superposed with said image-receiving sheet and including doubled over strips forming channels for slidably receiving the film and disposing it in a predetermined spaced relationship relative to said image-receiving sheet, said doubled over strips being so disposed as to be interposed between the film and said image-receiving sheet, when the film is received in the sleeve to space the film from said image-receiving sheet;

means for supplying a processing fluid to the space between the received film and said receiving sheet to process the film and transfer the transferable material from the film to the image-receiving section; and means for facilitating the removal of said image-receiving section of said receiving sheet from the remainder of said sleeve to provide a photographic picture comprising the dye image unencumbered by the remainder of said sleeve.

3. A processing sleeve for use with photograhic film processable by a fluid to transfer by diffusion an imagewise distribution of a material; said sleeve comprising:

an image-framing mask including a border, impervious to the diffusion material, about a central aperture;

an image-receiving sheet at least a major portion of which is strippably coupled to said mask, said strippable major portion including means for accepting the diffusion material through said mask aperture and immobilizing the material to form a dye image in said receiving sheet;

sheet means superposed with said image-receiving sheet and including doubled over portions forming channels for slidably receiving the film and disposing the received film in predetermined spaced relationship relative to said image-receiving sheet, said doubled over portions establishing said spacing; and means for supplying a processing fluid to the space between the received film and said receiving sheet to process the film and transfer the diffusion material to said receiving sheet.

4. A processing sleeve for receiving a film including a photosensitive emulsion for recording a latent image developable by a processing fluid to provide dyes transferable by diffusion in an imagewise distribution to an image-receiving sheet; said sleeve comprising:

pouch means for supplying a processing fluid to contact the received film to develop the latent image and provide imagewise distribution of dyes;

an image-receiving sheet including means for receiving from the film and for immobilizing the transferred dyes to form a visibly useful image in the receiving sheet;

a mask sheet including a dye-impervious border about a central aperture through which aperture the imagewise distribution of dyes is transferable to said image-receiving sheet, said mask border blocking such dye transfer to provide a dye-free border in the image-receiving sheet; and a third sheet forming a pocket with said image-receiving sheet for receiving the film in dye-transferable superposition with said image-receiving sheet, said third sheet forming integral strips for spacing the received film a predetermined distance from said image-receiving sheet.

5. A processing sleeve for use with a photographic film element suitable for recording a latent image developable by a processing fluid to transfer an imagewise distribution of diffusible dyes to an image-receiving sheet; said sleeve comprising:

an image-framing mask sheet including a dye-impervious border about a central aperture;

sheet means superposed with said mask sheet and including a central section and doubled over lateral edges forming channels for slidably receiving and disposing the film element in predetermined relationship relative to said mask sheet aperture;

an image-receiving sheet releasably coupled to said mask sheet for receiving through the mask sheet aperture and for immobilizing the dyes transferred from the film element to form an image in the receiving sheet, at least a major dye-receiving portion of said receiving sheet forming an outer boundary of said sleeve and being strippable from the remainder of the sleeve to facilitate retrieval and viewing of the visibly useful image; and means for supplying a processing fluid to said received film element to develop the latent image and transfer the dyes from the film element through the mask sheet aperture.

6. A processing sleeve for use with a photograhic film sheet processable by a fluid to form an imagewise distribution of material transferable by diffusion to an image-receiving sheet; said sleeve comprising:

sheet means having a flat central section and folded over edge portions forming channels for slidably receiving the film sheet;

an image-receiving sheet coupled to said sheet means and having a picture area including means for accepting and immobilizing the diffusion material from the received film sheet to form an image in said image-receiving sheet, said picture area of said image-receiving sheet being strippable from the remainder of the sleeve to provide a picture unencumbered by the remainder of the sleeve said image-receiving sheet being spaced from the received film sheet by said folded over edge portions of said sheet means; and means for supplying a processing fluid between said received film sheet and said image-receiving sheet to process the received film sheet and bring about the transfer of the imaging material to the image-receiving sheet, said folded over edge portions of said sheet means disposed between said received film sheet and said image-receiving sheet serving to establish a predetermined depth of the processing fluid between said received film sheet and said image-receiving sheet.

* * * * *

UNITED STATES PATENT AND TRADEMARK OFFICE

CERTIFICATE OF CORRECTION

PATENT NO. : 4,294,906

DATED : October 13, 1981

INVENTOR(S) : Philip D. Bechle and Joseph A. Roth

It is certified that error appears in the above—identified patent and that said Letters Patent is hereby corrected as shown below:

Column 1, line 25, "peelapart" should read --peel-apart--.

Column 2, line 6, "conveient" should read --convenient--;

line 13, "imagereceiving" should read --image-receiving--.

Column 3, line 2, "of" should read --the--;

line 48, "imagereceiving" should read --image-receiving--;

line 60, "imagereceiving" should read --image-receiving--.

Column 4, line 35, "proceeding" should read --preceeding--.

Signed and Sealed this

Nineteenth Day of January 198

[SEAL]

Attest:

GERALD J. MOSSINGHOFF

Attesting Officer

Commissioner of Patents and Trademarks